United States Patent [19]

Akpan

[11] Patent Number: 4,597,095

[45] Date of Patent: Jun. 24, 1986

[54] COMPOSITE STRUCTURE FOR ROTATING ANODE OF AN X-RAY TUBE

[75] Inventor: Edward Akpan, Florence, S.C.

[73] Assignee: General Electric Company, Milwaukee, Wis.

[21] Appl. No.: 603,815

[22] Filed: Apr. 25, 1984

[51] Int. Cl.[4] ..... H01J 35/10

[52] U.S. Cl. ..... 378/144; 378/143

[58] Field of Search ..... 378/143, 144, 129

[56] References Cited

U.S. PATENT DOCUMENTS

| | | | |
|---|---|---|---|
| 3,890,521 | 6/1975 | Shroff | 378/144 |
| 4,119,879 | 10/1978 | Devine | 378/144 |
| 4,145,632 | 3/1979 | Devine | 378/144 |

*Primary Examiner*—Craig E. Church

*Attorney, Agent, or Firm*—Douglas E. Stoner; Alexander M. Gerasimow

[57] ABSTRACT

In a composite anode structure having a refractory metal portion with a graphite portion attached thereto, an intersparsed zirconium brazing layer is isolated from the graphite material by a thin layer of platinum to thereby prevent the formation of embrittling carbides when the combination is raised to operating temperatures. The platinum is mechanically bonded to the graphite, and the zirconium is diffusion bonded to both the molybdenum portion and the platinum layer to form a high-strength, lasting bond.

13 Claims, 2 Drawing Figures

COMPOSITE STRUCTURE FOR ROTATING ANODE OF AN X-RAY TUBE

BACKGROUND OF THE INVENTION

This invention relates generally to X-ray tube anodes and, more particularly, to composite structures for X-ray tube rotating anodes.

With increased demands being placed on the performance of X-ray tubes, manufacturers have looked for ways to increase the efficiency and/or enhance the longevity of the X-ray tube target. One approach has been to substitute a graphite material for the conventional molybdenum material used in the target body. Graphite offers the advantages of both significantly higher heat storage capacity and lower density. The increased heat storage capacity allows for sustained operation at higher temperatures, whereas the lower density allows for the use of bigger targets with less mechanical stress on the bearing materials.

Along with the advantages of the graphite targets as discussed above, there are certain problems to overcome when one chooses that material over the commonly used refractory metal. First, it is more difficult to attach the graphite body to the rotatable stem of the X-ray tube than it is to attach a metal disc. Secondly, when a focal track is applied directly to a graphite substrate, the rate of heat transfer from the focal track to the substrate is slower than when the focal track is attached to a metal substrate. Under certain operating conditions, this can cause an overheating of the focal track and resultant damage to the target.

A known approach for obtaining the advantages of each of the commonly used materials, i.e., refractory metal and graphite, is to use a combination of the two in a so-called composite substrate structure. This structure is commonly characterized by the use of a refractory metal disc which is attached to the stem and which has affixed to its front side an annular focal track. Attached to its rear side, in concentric relationship to the stem, is a graphite disc which is, in effect, piggybacked to the refractory metal disc. Such a combination provides for (a) an easy attachment of the metal disc to the stem, (b) a satisfactory heat flow path from the focal track to the metal disc and then to the graphite disc, and (c) the increased heat storage capacity along with the low density characteristics of the graphite disc.

With a composite target, one of the main concerns is that of attaching the graphite portion to the refractory metal portion in a satisfactory manner. In addition to the obvious strength requirements, which are substantial when considering the rotational speeds of up to 10,000 RPM, relatively high operating temperatures on the order of 1,200° C. must also be accommodated. In addition, the metal and graphite elements must be adequately joined so as to provide for the maximum transfer of heat from the metal portion to the graphite portion. For example, it has been found that if there are air pockets between the two portions, the heat transfer characteristics will be inadequate in those sections.

A common method for joining the graphite portion to the metal portion is that of furnace or induction brazing with the use of an intermediate metal. Zirconium has been commonly used for that purpose because of its excellent flow and wetting characteristics. A problem that arises with the use of zirconium, however, is the formation of carbides at the interface between the zirconium and the graphite. Since the carbides tend to embrittle the joint, the strength of a joint is inversely related to both the amount of carbide formed and the thickness of the carbide layer. The amount of the carbide formed depends on the thermal history of the component during both the manufacturing and the operational phases thereof, neither of which can be adequately controlled so as to ensure that the undesirable carbides are not formed.

Other materials have been found useful in attaching the graphite portion to the metal portion of the target. A group of such materials that has been particularly suitable for such an attachment are those discussed in U.S. Pat. No. 4,145,632, issued on Mar. 20, 1979 and assigned to the assignee of the present invention. Those materials, and platinum in particular, were found to have a significant advantage over the zirconium material because of their insusceptibility to forming carbides. A significant disadvantage of these materials, however, is their relatively high cost. Since the thickness of the brazing material, as described in the above-mentioned patent, is in the range of 1/16 mils to 1 mils, the cost of the platinum or its equivalent for such use is prohibitive at today's prices.

It is therefore an object of the present invention to provide an economical composite X-ray target with a brazed interconnection having good strength and heat transfer characteristics.

Another object of the present invention is to provide a brazing material which is not susceptible to forming excessive carbides when heated while in close proximity to a graphite element.

Yet another object of the present invention is the provision in a composite target of a brazing material which is economical in use but effective in maintaining a strong bone between the graphite and metal components.

These objects and other features and advantages become more readily apparent upon reference to the following description when taken in conjunction with the appended drawings.

SUMMARY OF THE INVENTION

Briefly, in accordance with one aspect of the present invention, a relatively thin layer of a noncarbide-forming material, such as platinum, is applied to the graphite element to prevent the formation of carbides. A layer of zirconium is then applied to the platinum, and the metal disc portion is then placed over the zirconium layer. The combination is then heated to cause a brazing together of the materials. In this process, the zirconium becomes the primary binding material, while the thin layer of platinum functions to isolate the zirconium from direct contact with the graphite, a combination which would tend to form carbides.

By another aspect of the invention, the platinum is applied in the form of a film of a few angstroms thick by using platinum inks, screen printed on the graphite, with the resulting wet film being dried and fired to anneal the platinum to the graphite substrate. The zirconium layer and metal disc are then applied, and the combination is brazed in a conventional manner.

In the drawings as hereinafter described, a preferred embodiment is depicted. However, various other modifications and alternate constructions can be made thereto without departing from the true spirit and scope of the invention.

DESCRIPTION OF THE PREFERRED EMBODIMENT

Figure 1:
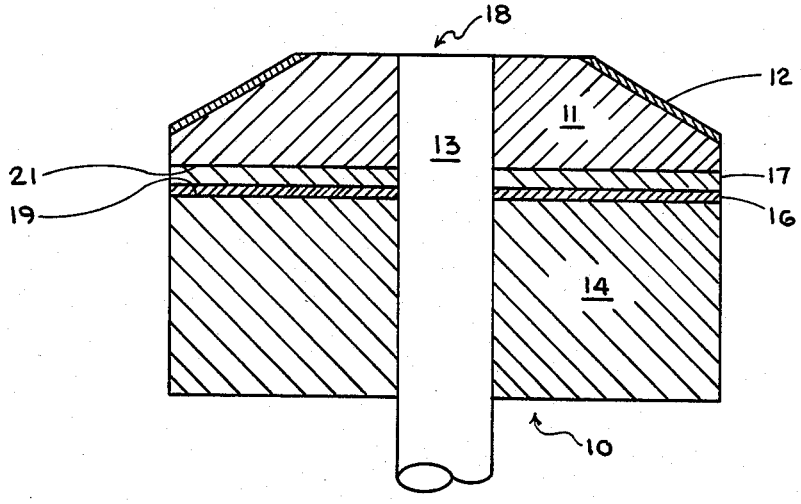
FIG. 1 is a sectional view of the X-ray target in accordance with the preferred embodiment of the invention.

Referring now to FIG. 1, there is shown an anode for use in a rotating anode X-ray tube in accordance with the invention. The assembly, indicated generally at 10, includes a metal disc 11 having a focal track 12 applied to one face thereof for producing X-rays when bombarded by the electrons from a cathode in a conventional manner. The disc 11 is composed of a suitable refractory metal such as molybdenum or a molybdenum alloy. The conventional focal track 12 disposed thereon is composed of a tungsten or a tungsten/rhenium alloy material. The disc 11 is attached to the stem 13 by a conventional method, such as by brazing, diffusion bonding, or mechanical attachment.

Attached to the rear side of the metal disc 11 is a graphite disc 14, the attachment being made by the interspersing of adjacent layers of platinum and zirconium, indicated generally by the numerals 16 and 17, respectively, in a manner to be described hereinafter. The primary purpose of the graphite disc 14 is to provide a heat sink for the heat which is transferred through the metal disc 11 from the focal track 11, without contributing significantly to the mass of the target assembly.

Figure 2:
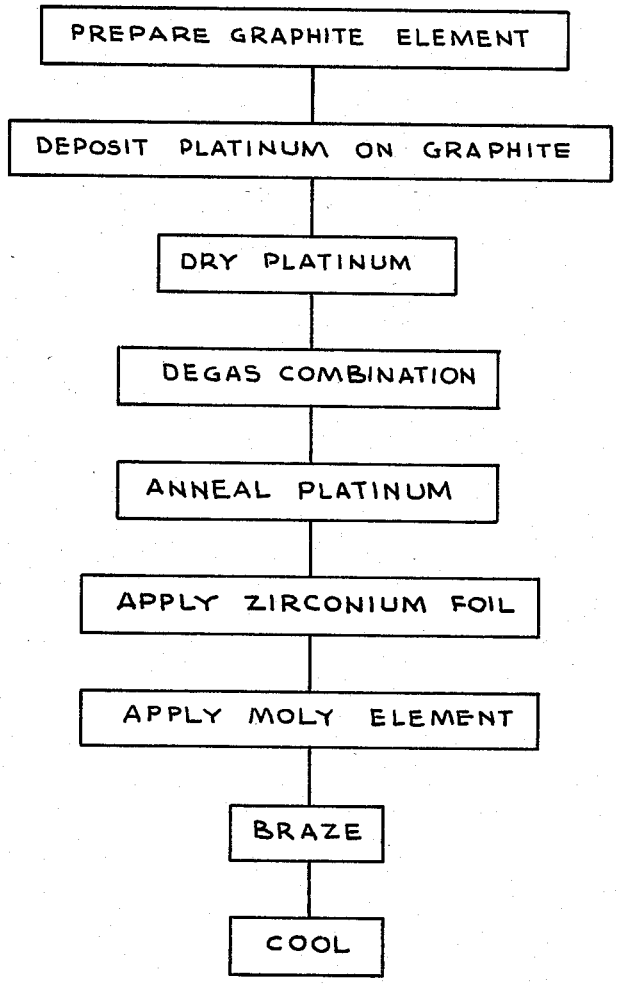
FIG. 2 is a flow diagram showing the process of anode fabrication in accordance with the preferred embodiment of the invention.

A method for fabricating the anode assembly is shown in FIG. 2. For purposes of discussion, let us assume that the metal disc element 11 and graphite disc element 14 have been formed by conventional methods with each having a central bore 18 for receiving in close-fit relationship the stem 13 of the X-ray tube.

The graphite element 14 is first cleaned, with particular care being given to the flat surface 19 to which the flat surface 21 of the metal element 11 is to be attached. The other surfaces of the graphite disc 14 are preferably treated by ultrasonic cleaning or other suitable surface treatment processes to prevent the release of graphite particles (dusting) during operation of the tube.

The platinum layer 16 is applied to the flat surface 19 of the graphite disc 14 by a suitable means, such as a screen process, plasma spraying, electroplating, or sputtering. In order to minimize cost, the thickness of the platinum layer should be kept to a minimum, just sufficient to completely cover the grooves of the graphite surface so as to prevent carbide formation when the zirconium layer is substantially applied. The thickness should therefore be 1/16 mils or less and, depending on the quality of the graphite and the method of application, as thin as 5–10 angstroms, if possible.

A preferred method application of the platinum has been found to be by the process of screen printing with platinum inks. The screen can be made of polyester or stainless steel with a mesh that is preferably between 180 and 325 lines per inch. The thick film screen is preferably coated with an emulsion that varies in thickness from 0.4 to 1.5 mils. A soft plastic squeegee has been found suitable for applying a uniform coating of platinum ink over the screen with particular care being given to carefully controlling the following variables: squeegee pressure, squeegee speed, snap-off distance, and squeegee hardness.

After the platinum film is printed, the resulting wet film is dried in a standard convection box oven or an infrared belt oven at 100°–150° C. for 10–15 minutes. The film will then be dry to the touch and ready for firing. Firing has been successfully accomplished at temperatures of 1705°–1750° C. for 10 minutes, the carbon-platinum eutectic temperature being 1705° C. Once fired, the platinum coating will be completely bonded and annealed to the graphite disc 14. Although there is some diffusion bonding that results in the firing process, the resulting platinum-to-graphite bond is substantially a mechanical rather than a diffusion bond.

It should be mentioned that other noncarbide-forming elements may be used in place of the platinum in the manner described above. For example, any of the elements rhodium, osmium, ruthenium, palladium, or a platinum-chromium alloy may be used as the material for isolating the zirconium layer from the graphite. The required characteristics are, first of all, that the material be essentially noncarbide forming, and secondly that it be susceptible to the spreading of a very thin layer. To facilitate screen printing, for example, it is desirable that the material be obtainable in a fine-powder form (i.e., 10 microns or less) and be dissolvable in a suitable solvent for the formation of an ink. Platinum has been found to be particularly suitable because of its relatively good accessibility and because of the experience with platinum in the screen printing industry.

After drying the platinum layer but before proceding with the annealing process, it may be desirable to de-gas the graphite-and-platinum combination by conventional means, as by heating to 1200° C. in a vacuum for 3 hours, for example.

After annealing the platinum, the zirconium layer 17 is applied, preferably in the form of a foil. The thickness of the zirconium should be minimized, since an increase in thickness beyond the minimum required tends to weaken the resulting brazed joint. A preferred thickness has been found to be 2 mils or less.

Following the application of the zirconium layer 17, the refractory metal disc 11 is placed over that layer, and the composite assembly is brazed using either a resistance furnace or an induction heater. This is preferably accomplished in an inert atmosphere, such as a vacuum, at a temperature between 1600°–1900° C. for a period of 0–10 minutes. With the assembly remaining in the furnace over a period of 4–6 hours, the heat is removed and a flowing argon atmosphere is created to flush the furnace and to lower the temperature to ambient temperature, after which the assembly can be removed from the furnace.

During the brazing process, the zirconium diffuses into the platinum in the one direction and into the molybdenum or molybdenum alloy in the other direction to thereby form a strong bond which is not susceptible to the formation of carbides during subsequent heating to operational temperature levels.

What is claimed as new and desired to be secured by Letters Patent of the United States is:

1. An X-ray tube target comprising a graphite substrate forming a portion of the target and having an upper surface;

a platinum layer bonded to said substrate upper surface;

a zirconium layer bonded to said platinum layer and isolated by said platinum layer from said substrate so as not to be susceptible to the formation of carbides when exposed to higher temperatures; and a metal portion bonded to said zirconium layer and having on its exposed surface a focal track for receiving electrons for producing X-rays.

2. An X-ray tube target as set forth in claim 1 wherein said platinum layer is no greater than 1/16 mils in thickness.

3. An X-ray tube target as set forth in claim 1 wherein the thickness of said platinum layer is in the range of 5–10 angstroms.

4. An X-ray tube target as set forth in claim 1 wherein said zirconium layer is no greater than 2 mils in thickness.

5. An X-ray tube target as set forth in claim 1 wherein said metal portion is comprised of a molybdenum or molybdenum alloy material.

6. A composite target for an X-ray tube comprising a graphite substrate portion and a metal portion, the two portions being bonded together by successive interspersed layers of platinum and zirconium, wherein said platinum layer is disposed between said graphite substrate portion and said zirconium layer and wherein said platinum layer is less than 1/16 mils in thickness.

7. A composite target as set forth in claim 1 wherein said zirconium layer is less than 2 mils in thickness.

8. In a composite X-ray target of the type having a graphite substrate portion to which a metal portion is attached, a bonding structure comprising a first layer formed of a noncarbide-forming material selected from the group consisting of platinum, palladium and rhodium bonded to said graphite portion, and a second layer composed of zirconium and disposed between and acting to bond said target together, wherein said noncarbide-forming material isolates said zirconium layer from said graphite portion to prevent the formation of carbides.

9. A bonding structure as set forth in claim 8 wherein said first layer is composed of platinum.

10. A method of joining a metal portion of an X-ray tube target to a graphite substrate portion thereof comprising the steps of (1) applying a first layer to one face of the graphite substrate portion, said first layer being composed of a noncarbide-forming material;

(2) applying a layer of zirconium to said first layer, which zirconium layer is isolated from said substrate by said noncarbide-forming material;

(3) placing the metal portion over said zirconium layer; and (4) heating the combination to thereby braze the metal portion to the graphite portion.

11. A method as set forth in claim 10 wherein said first layer is applied by screen printing said noncarbide-forming material on the graphite substrate portion.

12. A method as set forth in claim 10 wherein said first layer is applied with a thickness of less than 1/16 mils.

13. A method as set forth in claim 10 wherein said zirconium layer is applied with a thickness not exceeding 2 mils.

* * * * *